US006896127B2

(12) United States Patent
Ragley

(10) Patent No.: US 6,896,127 B2
(45) Date of Patent: May 24, 2005

(54) COIN DISPLAY APPARATUS AND METHOD USING ROTATABLE HANGERS TO SUSPEND COINS FROM A TRACKWAY

(76) Inventor: Sandra Ragley, 45-175-G Lilipuna Rd., Kaneohe, HI (US) 96744

( * ) Notice: Subject to any disclaimer, the term of this patent is extended or adjusted under 35 U.S.C. 154(b) by 220 days.

(21) Appl. No.: 10/287,214

(22) Filed: Nov. 4, 2002

(65) Prior Publication Data

US 2004/0084329 A1 May 6, 2004

(51) Int. Cl.[7] ..... A45C 1/00
(52) U.S. Cl. ..... 206/0.8; 206/806
(58) Field of Search ..... 206/0.8, 0.81, 206/0.815, 0.82, 0.83, 0.84, 806

(56) References Cited

U.S. PATENT DOCUMENTS

| | | | | |
|---|---|---|---|---|
| 2,708,999 A | | 5/1955 | Rush | |
| 3,776,643 A | | 12/1973 | Titoff | |
| 3,964,187 A | | 6/1976 | Stumpf | |
| 4,401,221 A | * | 8/1983 | Suttles | 211/59.2 |
| 4,771,897 A | * | 9/1988 | Ho | 211/85.9 |
| 4,775,127 A | | 10/1988 | Nakamura et al. | |
| 4,981,207 A | * | 1/1991 | Kuikka | 198/735.3 |
| 4,984,854 A | | 1/1991 | DeLavallade | |
| 5,242,048 A | | 9/1993 | Ellingsworth et al. | |

OTHER PUBLICATIONS

Challenge Coin Display Case—Patent Pending Quality Challenge Coins. Downloaded from wemakecoins.com/patent/, pp 1–5.
Challenge Coin Display Case—Patent Pending Quality Challenge Coins. Dwonloaded from wemakecoins.com/patent/, pp 1–8.

* cited by examiner

*Primary Examiner*—Jacob K. Ackun, Jr.
(74) *Attorney, Agent, or Firm*—Lyon & Harr, L.L.P; Craig S. Fischer

(57) ABSTRACT

The coin display apparatus and method described herein includes rotatable hangers suspended from a trackway for displaying and positioning coins. In general, the coin display apparatus includes a rotatable hanger, a tab for attaching a coin to the rotatable hanger, and a trackway for suspending the hanger/coin arrangement. The coin is positionable along the trackway by sliding the rotatable hanger up and down the trackway to a desired location. In addition, the rotatable hanger includes a swivel arrangement such that the coin may be rotated individually around a longitudinal axis of the rotatable hanger so that the front or back of the coin may be displayed. This allows great flexibility in arranging the coins within the coin display apparatus such that symmetrical spacing is preserved, regardless of the number of coin in the collection. The coin display method includes using the coin display apparatus to display and position coins.

16 Claims, 4 Drawing Sheets

COIN DISPLAY APPARATUS AND METHOD USING ROTATABLE HANGERS TO SUSPEND COINS FROM A TRACKWAY

TECHNICAL FIELD

The present invention relates in general to the display of coins and more particularly to a coin display apparatus and method that uses rotatable hangers suspended from a trackway to individually display the coins.

BACKGROUND OF THE INVENTION

Challenge (or unit) coins are items that are popular with all branches of the military and paramilitary groups (such as police and fire departments). The coins represent the branch of the service or unit to which a person is attached. There is much tradition, history and lore with regard to challenge coins. Challenge coins were originally used by Special Forces to recognize soldiers for outstanding acts, to boost morale, and to build camaraderie. Today, challenge coins used to show pride in affiliating with a particular organization. Challenge coins are also designed to commemorate a specific event. No longer available just to members of a particular organization, challenge coins now have become available to the general public (including collectors) through sales at the post office and other venues.

Once challenge coins have been acquired the problem becomes how to display the coins. Most traditional coin displays are complicated and difficult to manufacture. Many of these display cases have a casing in which the coin is inserted. The problem with these cases, however, is that odd-shaped coins usually do not fit in the casing and thus cannot be displayed in the display case. Another problem with traditional display cases is that the location of the coins on each level is fixed. Thus, depending on the number of coins being displayed, symmetric spacing between the coins is either impossible or difficult to achieve. Thus, what is needed is a coin display apparatus and method that displays coins to their maximum advantage and allows easy, simple and individual positioning and inspection of each coin being displayed.

SUMMARY OF THE INVENTION

The coin display apparatus and method disclosed herein include a positioning and suspension arrangement for displaying and positioning coins. The coin display apparatus and method allow easy positioning of each individual coin on display so that each coin is displayed to its maximum advantage. The positioning and suspension arrangement is within a supporting framework and allows a number of coins to be displayed on individual hangers that may be rotated and moved laterally along a trackway. This facilitates quick, easy and flexible arrangement of the coins within the supporting framework to provide symmetrical spacing, regardless of the number of coins being displayed. As new coins are added to or removed from display the existing coins can be easily rearranged within supporting framework to provide an aesthetically-pleasing appearance.

In general, the coin display apparatus includes a supporting framework and a positioning and suspension arrangement within the supporting framework. More specifically, the supporting framework includes two side members and a top cross member that is perpendicular to the two side members. The top cross member includes a trackway for suspending the coins. The trackway includes a top slot and a bottom slot, with width of the top slot being greater than the width of the bottom slot.

A hanger is suspended from the trackway by inserting a swivel arrangement at one end of the hanger between the top and bottom slots. This allows the hanger to be moved along the trackway. In a preferred embodiment, the hanger is a rotatable hanger that allows 360 degree rotational of the hanger. A coin is removably attached to the hanger by way of a tab. The tab attaches to the coin using an adhesive area, and the tab removably attaches to the hanger by way of a cutout that fits over the hanger. In this manner, a coin can easily be removed from its hanger for individual inspection.

The coin display method of the present invention uses the coin display apparatus to display and arrange coins. In general, the method includes using the positioning and suspension arrangement to display and position coins. In particular, the method includes attaching a tab to a coin, hanging the coin/tab arrangement from the hanger, and suspending the hanger from the trackway. Next, the coin is positioned along the trackway and rotated about the hanger to achieve a desired positioning of the coin.

BRIEF DESCRIPTION OF THE DRAWINGS

The present invention can be further understood by reference to the following description and attached drawings that illustrate aspects of the invention. Other features and advantages will be apparent from the following detailed description of the invention, taken in conjunction with the accompanying drawings, which illustrate, by way of example, the principles of the present invention.

Referring now to the drawings in which like reference numbers represent corresponding parts throughout.

DETAILED DESCRIPTION OF THE INVENTION

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

The coin display apparatus and method described herein includes a trackway that accepts rotatable hangers for displaying coins. Each coin can be hung individually from a hanger and individually positioned for maximum display effect. A coin is positionable in the horizontal direction by sliding the rotatable hanger up and down the trackway to a desired location. In addition, a coin may be rotated individually around a longitudinal axis of the rotatable hanger such that the front or back of the coin is displayed. This allows great flexibility in arranging the coins within the coin display apparatus such that symmetrical spacing is preserved, regardless of the number of coin in the collection.

II. Coin Display Apparatus

The coin display apparatus described herein is a framework in which a number of coins can be displayed in an aesthetically-pleasing manner. As coins are added to or subtracted from the apparatus the manner in which each coin is attached to the coin display apparatus allows easy and independent rearrangement of the coins in order to maintain symmetry between the coins. In addition, the coin display apparatus allows easy removal of each coin for close-up inspection.

Figure 1:
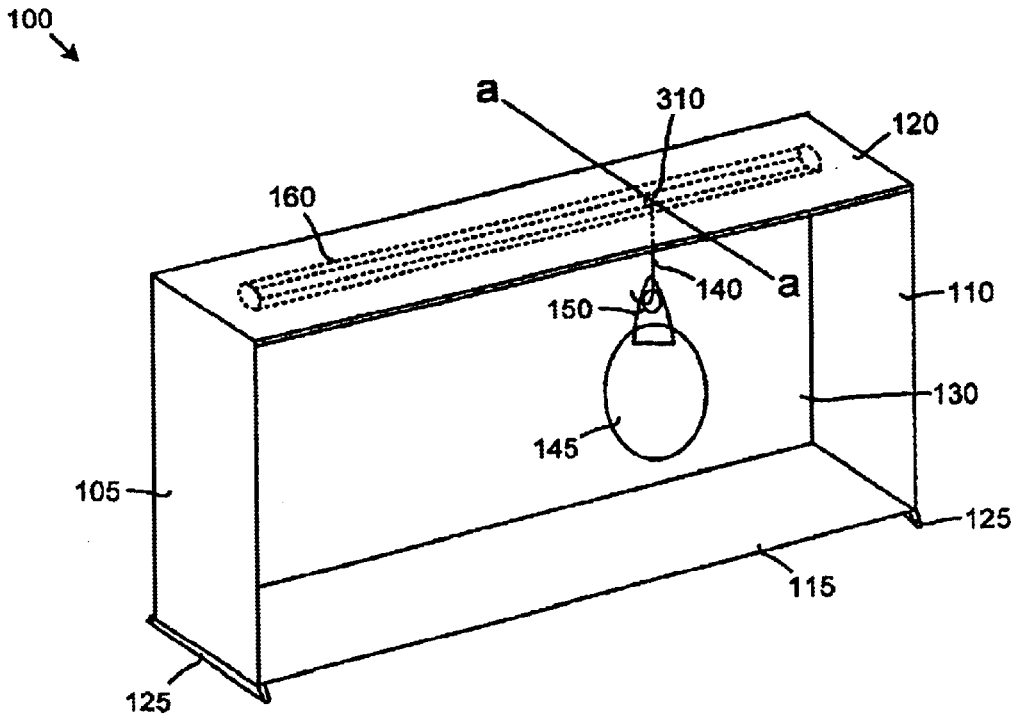
FIG. 1 is a perspective view illustrating a general overview of an embodiment of the coin display apparatus and method described herein.

FIG. 1 is a perspective view illustrating a general overview of an embodiment of the coin display apparatus and method described herein. In general, the coin display apparatus 100 allows coins (and other similar objects such as, for example, medallions) to be suspended from a rotatable hanger along a trackway such that the coins are displayed to their maximum advantage. In particular, as shown in FIG. 1, the coin display apparatus 100 includes a supporting framework for hanging and displaying the coins. The supporting framework includes a first side member 105, a second side member 110, an optional bottom cross member 115 and a top cross member 120. In a preferred embodiment, the supporting framework is constructed of a hardwood that is finished in either a stained or painted finish as desired.

The coin display apparatus 100 shown in FIG. 1 includes an optional base 125 for stability. This optional base 125 allows the coin display apparatus to stand alone on a desk, shelf or cabinet. In an alternate embodiment, the coin display apparatus 100 is designed such that the apparatus can be hung on a wall. The coin display apparatus 100 also includes an optional background panel 130 attached to the rear of the supporting framework. As with the supporting framework, the background panel 130 can be finished in a variety of finishes and colors. Typically, the colors of the background panel 130 will reflect the coin collection owner's own unit or branch of the military. By way of example, the color of the background panel 130 may be deep blue for the Navy or maroon for the Marines.

The coin display apparatus also includes a rotatable hanger 140 suspended from the top cross member 120. A coin 145 for display is attached to the rotatable hanger 140 using a tab 150. The rotatable hanger 140 and the tab 150 are discussed in detail below. The top cross member 120 includes trackway 160 formed into the bottom of the top cross member 120 for suspending the rotatable hanger 140. The rotatable hanger 140 is designed such that it can slide back and forth across the trackway 160. This arrangement allows the coin 150 to be positioned anywhere along the trackway 160. The trackway is discussed in detail below.

Figure 2:
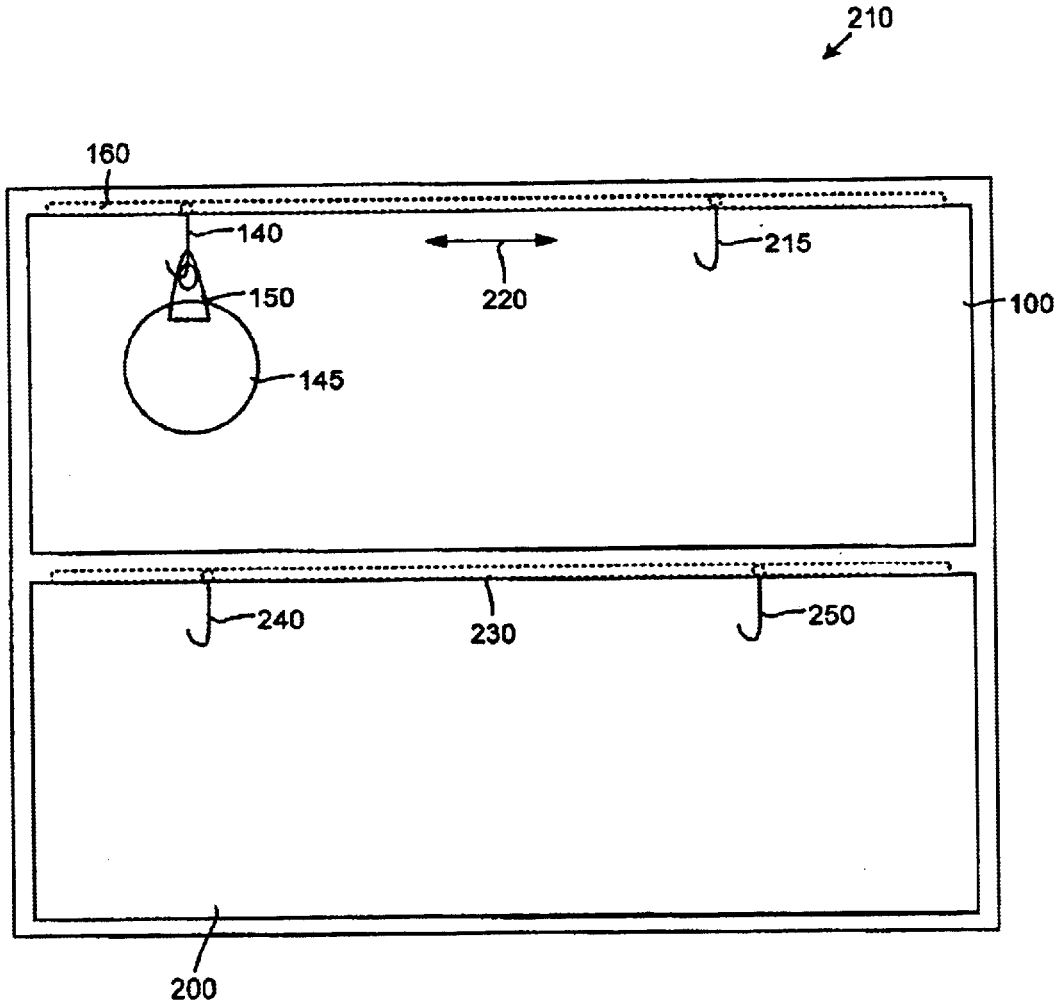
FIG. 2 illustrates a front view of another embodiment of the coin display apparatus described herein.

The size if the coin display apparatus can vary, depending on the size of the coins being displayed and the number of coins being displayed. In addition, the coin display apparatus can be stacked or placed on top of one another to provide additional display area. FIG. 2 illustrates a front view of another embodiment of the coin display apparatus described herein. In particular, the coin display apparatus 100 is stacked on top of a second coin display apparatus 200 to form a stacked display apparatus 210. As described above, the coin display apparatus 100 includes the rotatable hanger 140 and a second rotatable hanger 215. Both hangers 140, 215 are capable of sliding along the trackway 160, as indicated by the arrow 220. The second coin display apparatus 200 also includes a second trackway 230 and rotatable hangers 240, 250 for suspending coins.

Rotatable Hangers, Tab and Trackway

Figure 3:
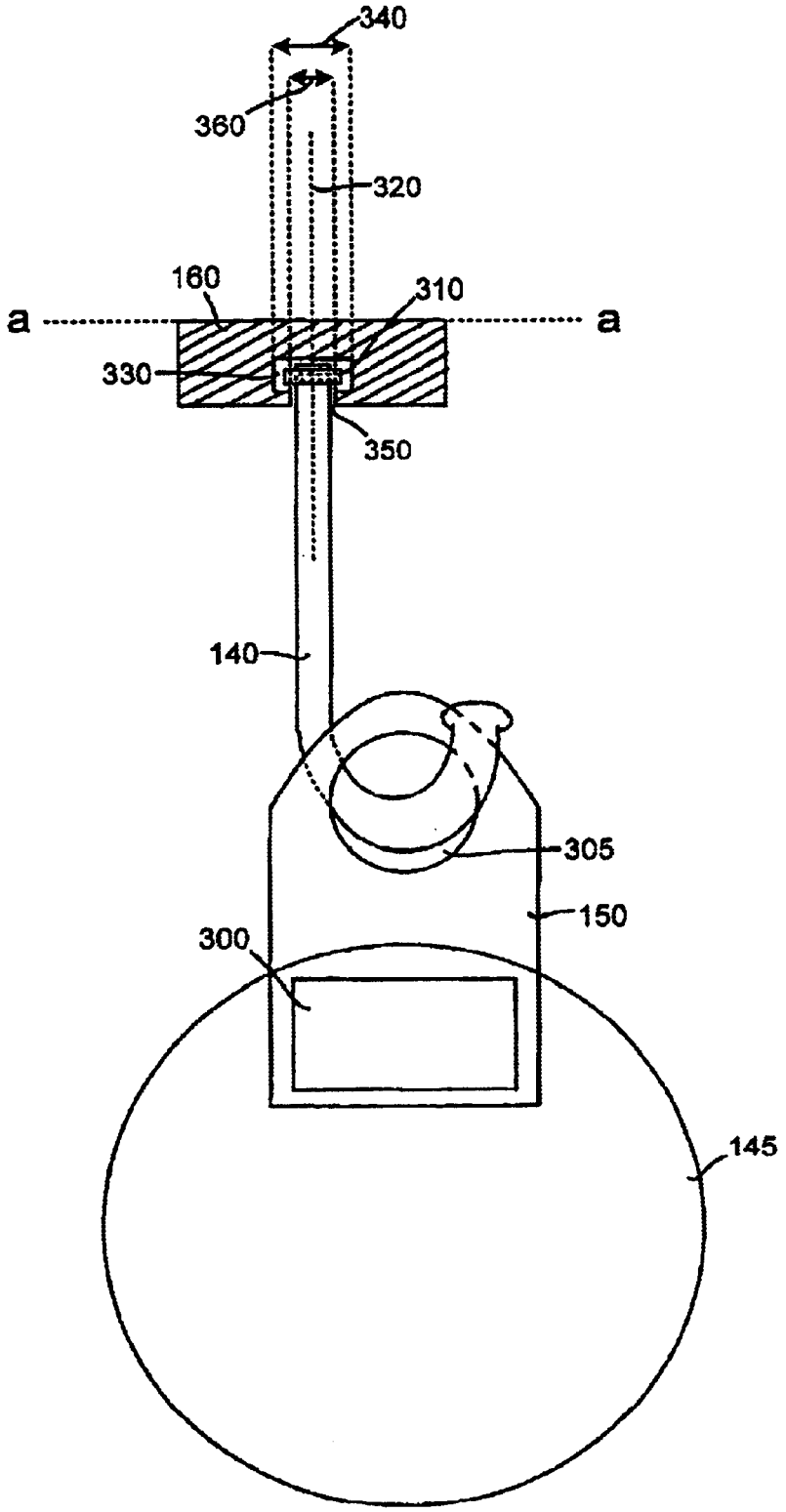
FIG. 3 is a cross-section of the trackway and rotatable hanger arrangement shown in FIGS. 1 and 2.

The unique positioning and suspension arrangement that includes the rotatable hangers, tabs and trackway of the coin display apparatus shown in FIGS. 1 and 2 now will be discussed. FIG. 3 is a cross-section (taken through line a—a shown in FIG. 1) of the trackway and rotatable hanger arrangement shown in FIGS. 1 and 2. In general, the rotatable hanger and trackway arrangement provide the coin display apparatus with an quick and easy way to add and remove coins from display, position the coins, and view the coins. In particular, the coin 145 is removably attached to the rotatable hanger 140 using the tab 150. As explained in detail below, the tab has a void that allows the tab/coin combination to be easily engaged and disengaged from the rotatable hanger.

In a preferred embodiment, the tab 150 is a clear, removable plastic tab having an adhesive area in 300 contact with the coin 145. The coin 145 is attached to the tab 150 by pressing the coin onto the adhesive area 300 of the tab 150. The tab 150 also includes a cutout 305 having a size such that the tab 150 and the attached coin 145 can be placed onto the rotatable hanger 140. This arrangement by which each individual coin is attached to its rotatable hanger makes the size and shape of each coin irrelevant. In other words, coins of irregular size and shape, such as arrowheads, "dog-tag" shapes, and triangular shapes can all be displayed in the coin display apparatus 100 using the tab 150 to attach a coin to the rotatable hanger 140.

The rotatable hanger 140 includes a swivel arrangement 310 whereby the rotatable hanger 140 can be rotated around a longitudinal axis 320 of the rotatable hanger 140. In the embodiment shown in FIG. 3, the longitudinal axis 320 corresponds to a vertical axis. In a preferred embodiment, the swivel arrangement 310 is a bearing that allows the rotatable hanger 140 to rotate 360 degrees around the axis 320. The rotatable hanger 140 provides for easy, independent 360 degree rotation of each coin. This means that the front and back of the coin 145 can be display by rotating the coin 145 on the rotatable hanger 140 and without having to remove the coin 145 from the hanger 140. This allows for full viewing of the entire design of the coin 145, both front and back, without having to remove the coin from the coin display apparatus 100. It should be noted that, unlike currency coins, each side of a challenge coin is oriented in the same direction.

The rotatable hanger 140 is suspended from the trackway 160 via the swivel arrangement 310. The rotatable hanger 140 can be slidably moved along the trackway 160 in order to position the hanger 140 and attached coin 145 in a desired location along the trackway 160. As shown in FIG. 2, the trackway 160 can support several rotatable hangers. Each coin hangs on its own individual rotatable hanger, which is independent of the other hangers. In addition, a coin can easily be removed from its hanger to allow close-up inspection and handling. As new coins and rotatable hangers are added to the trackway 160, suspended coins can be positioned along the trackway 160 for optimal display effect. This allows the existing coins to easily be rearranged with the space on each level as desired. Thus, symmetrical spacing can easily be achieved by positioning the coins along the trackway 160.

The trackway 160 includes a top slot 330 having a first width 340 and a bottom slot 350 having a second width 360. The first width 340 is wider than the second width 360, so that the swivel arrangement 310 can slide within the top slot 330 while being supported by the bottom slot 350. Embellishments such as lighting (not shown) may be embedded into the trackway 160 to provide accent lighting of each suspended coin. By way of example, this lighting includes a light-emitting diode (LED) "rope" lighting embedded in the trackway 160 to provide the accent lighting.

Figure 4:
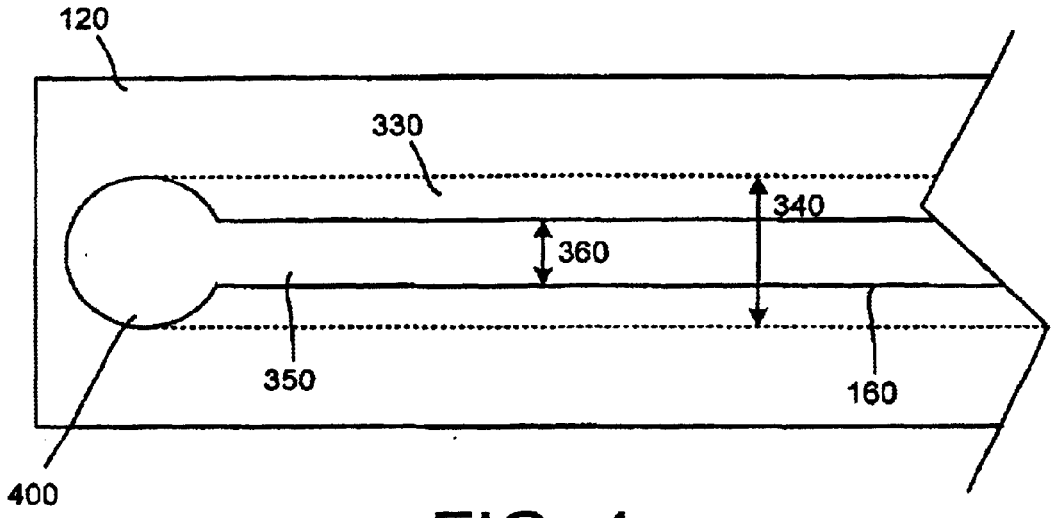
FIG. 4 is an underneath view of the top panel of the coin display apparatus illustrating details of the trackway shown in FIGS. 1, 2 and 3.

FIG. 4 is an underneath view of the top cross member 120 of the coin display apparatus 100 illustrating details of the trackway 160 shown in FIGS. 1, 2 and 3. As discussed above, the trackway 160 includes a bottom slot 350 having a second width 360 and a top slot 330 having a first width 340. In addition, the trackway 160 includes a hanger insert 400. The hanger insert 400 is sized a slightly bigger than the swivel arrangement 310 on the rotatable hanger 140 to allow the rotatable hanger 140 to be inserted onto the trackway 160 or removed from the trackway 160. The trackway 160 includes at least one hanger insert 400 located on at least one end of the trackway 160.

III. Operational Overview

Figure 5:
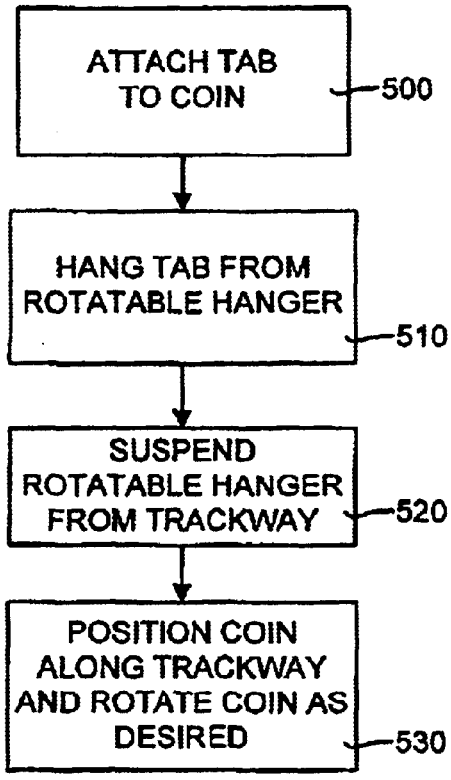
FIG. 5 is a general flow diagram illustrating the operation of the coin display method described herein.

The coin display method described herein uses the coin display apparatus to display and arrange coins and similar objects. FIG. 5 is a general flow diagram illustrating the operation of the coin display method described herein. The method begins by attaching a tab to a coin to be displayed (box 500). Preferably, the tab is an adhesive tab having an adhesive area with which to attach the coin. The tab then is hung from the rotatable hanger (box 510). Next, the rotatable hanger is suspended from a trackway such that the hanger can be slidably moved back and forth along the trackway (box 520). Finally, the coin is positioned along the trackway and rotated as desired (box 530). In this manner, the coin can be positioned to provide symmetric spacing between coins and to display a preferred side of the coin.

The foregoing description of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description of the invention, but rather by the claims appended hereto.

What is claimed is:

1. A coin display apparatus for displaying at least one coin, comprising:

a first side member;

a second side member;

a top cross member attached generally perpendicularly to the first side member and the second side member;

a trackway formed in an underside of the top cross member; and a rotatable hanger having the coin thereon and suspended from the trackway for displaying the coin and allowing rotation of the coin on the rotatable hanger.

2. The coin display apparatus of claim 1, further comprising a tab that attaches to the coin, attaches the coin to the rotatable hanger, and allows the coin to be suspended from the trackway.

3. The coin display apparatus of claim 1, wherein the rotatable hanger further comprises a swivel arrangement and the trackway further comprises a top slot having a first width and a bottom slot having a second width that is less than the first width, and whereby the swivel arrangement fits between the top slot and the bottom slot such that the rotatable hanger can be slidably positioned along the trackway.

4. A method for displaying a coin, comprising:

attaching a tab to the coin;

hanging the tab from a hanger;

suspending the hanger from a trackway; and positioning the coin along the trackway as desired.

5. The method of claim 4, wherein the hanger is a rotatable hanger, and further comprising rotating the coin to display a desired side of the coin.

6. The method of claim 4, wherein attaching the tab to the coin further comprises using a clear tab having an adhesive area to attach the tab to the coin.

7. The coin display apparatus of claim 1, wherein the trackway further comprises:

a top slot having a first width; and a bottom slot having a second width that is less than the first width.

8. The coin display apparatus of claim 7, further comprising a hanger insert disposed on at least one end of the trackway that allows the insertion of the rotatable hanger onto the trackway.

9. The coin display apparatus of claim 8, further comprising lighting embedded in the trackway to provide accent lighting of the coin.

10. The coin display apparatus of claim 9, wherein the lighting is a light-emitting diode (LED) lighting.

11. The coin display apparatus of claim 1, wherein the rotatable hanger further comprises a swivel arrangement such that the rotatable hanger can be rotated around a longitudinal axis of the rotatable hanger.

12. The coin display apparatus of claim 11, wherein the swivel arrangement is a bearing that allows the rotatable hanger to rotate 360 degrees around the longitudinal axis.

13. The coin display apparatus of claim 11, wherein the trackway further comprises a top slot having a first width and a bottom slot having a second width that is less than the first width, and wherein the swivel arrangement is disposed between the top slot and the bottom slot such that the rotatable hanger is suspended from the trackway.

14. The coin display apparatus of claim 1, further comprising a tab that removably attaches the coin to the rotatable hanger to allow for easy engagement and disengagement of the coin to the hanger.

15. The coin display apparatus of claim 14, wherein the tab further comprises an adhesive area in contact with the coin for attaching the coin to the tab.

16. The coin display apparatus of claim 15, wherein the tab further comprises a cutout that allows easy engagement and disengagement of the coin to the hanger.

* * * * *